US007782289B2

(12) United States Patent
Shen et al.

(10) Patent No.: US 7,782,289 B2
(45) Date of Patent: Aug. 24, 2010

(54) TIMING CONTROLLER FOR CONTROLLING PIXEL LEVEL MULTIPLEXING DISPLAY PANEL

(75) Inventors: Kuo-Liang Shen, Hsinchu (TW); Chien-Yu Yi, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 972 days.

(21) Appl. No.: 11/553,461

(22) Filed: Oct. 26, 2006

(65) Prior Publication Data

US 2007/0290978 A1 Dec. 20, 2007

(30) Foreign Application Priority Data

Jun. 15, 2006 (TW) ..... 95121378 A

(51) Int. Cl.
*G09G 3/36* (2006.01)

(52) U.S. Cl. ..... 345/99; 345/94

(58) Field of Classification Search ..... 345/87, 345/94, 98–100, 204

See application file for complete search history.

(56) References Cited

U.S. PATENT DOCUMENTS 6,072,457 A * 6/2000 Hashimoto et al. ..... 345/100
6,559,839 B1 * 5/2003 Ueno et al. ..... 345/213
7,352,349 B2 * 4/2008 Baek et al. ..... 345/92

* cited by examiner

*Primary Examiner*—Sumati Lefkowitz
*Assistant Examiner*—Rodney Amadiz
(74) *Attorney, Agent, or Firm*—Jianq Chyun IP Office

(57) ABSTRACT

A timing controller including a memory and a memory controller is provided. The memory includes an odd-field block and an even-field block. The memory controller is coupled to the memory and controls the memory. When two of a first, a second and a third gate output enable signals output by the timing controller are active, the memory is controlled to output the data of the $(I-1)^{th}$ scan line stored in the odd-field block. When one of the first, the second and the third gate output enable signals output by the timing controller is active, and the other two signals are inactive, the memory is controlled to output the data of $J^{th}$ scan line stored in the even-field block and write an odd-field field data of the $(J+1)^{th}$ scan line to the odd-field block and write an even-field field data of the $(J+1)^{th}$ scan line to the even-field block.

11 Claims, 14 Drawing Sheets

401

TIMING CONTROLLER FOR CONTROLLING PIXEL LEVEL MULTIPLEXING DISPLAY PANEL

CROSS-REFERENCE TO RELATED APPLICATION

This application claims the priority benefit of Taiwan application serial no. 95121378, filed Jun. 15, 2006. All disclosure of the Taiwan application is incorporated herein by reference.

BACKGROUND OF THE INVENTION

1. Field of Invention

The present invention relates to a driving circuit of a flat panel display, and more particularly, to a timing controller applicable for controlling a pixel level multiplexing display panel, and a timing controller that is provided without changing architectures of a conventional data driving circuit and a scan driving circuit.

2. Description of Related Art

Flat panel displays, such as a liquid crystal display (LCD), have been widely used in recent years. As the progress of the semiconductor technology, the liquid crystal display (LCD) panel has the advantages of low power consumption, being thin and light, high resolution, high color saturation, long life time, and so on, therefore, it has been widely applied in electronic products closely relevant to the daily life, including liquid crystal screens of a laptop or a desktop computer and an LCD TV.

FIG. 1 is a part of a circuit diagram of a conventional LCD panel. The LCD panel comprises a plurality of pixels 10. Each pixel 10 comprises: a thin film transistor (TFT) 100, a data storage capacitor 101 and a pixel capacitor 102, wherein the gate of the TFT 100 is respectively coupled to the corresponding gate lines G1-G5, and the source of the TFT 100 is respectively coupled to the corresponding source line $S_n$-$S_{n+7}$.

FIGS. 2A-2D are driving timings of the conventional LCD panel in the configuration of FIG. 1. In FIGS. 2A-2D, each block P(1,1)~P(M,N) represents one pixel respectively. The controlling manner of the LCD in such a configuration is to enable each of the gate lines $G_1$~$G_M$ in sequence, wherein when $G_1$ is enabled, the data of P(1,1)~P(1,N) are sent to the source line of the panel, when $G_2$ is enabled, the data of P(2,1)~P(2,N) are sent to the source line of the panel, and when $G_M$ is enabled, the data of P(m,1)~P(m,N) are sent to the source line of the panel . . . and so forth, which is finished until the whole picture is displayed. When the horizontal resolution of the panel is N, the display panel at least needs N source lines.

FIG. 3 is a pixel level multiplexing (PLM) display panel. Compared with the conventional art of FIG. 1, the source lines in the panel are one half of that of the conventional LCD panel in FIG. 1. In this panel, two pixels share one source line, and it must be driven by way of time-division multiplexing. Therefore, the conventional timing controller cannot be used in this panel.

SUMMARY OF THE INVENTION

An objective of the present invention is to provide a timing controller for driving a pixel level multiplexing display panel, and particularly, the timing controller drives the pixel level multiplexing display panel without changing architectures of conventional scan and data driving circuits, thereby saving the cost.

The present invention provides a timing controller applicable for controlling a pixel level multiplexing display panel, wherein the timing controller comprises a memory and a memory controller. The memory comprises an odd-field memory block and an even-field memory block. The memory controller is coupled to the memory and controls the memory. When two of a first, second and third gate output enable signals output by the timing controller are active, the memory is controlled to output the data of the $(I-1)^{th}$ scan line stored in the odd-field memory block. When one of the first, second and third gate output enable signals output by the timing controller is active, and the other two signals are inactive, the memory is controlled to output the data of the $J^{th}$ scan line stored in the even-field memory block, and write an odd-field field data of the $(J+1)^{th}$ scan line to the odd-field memory block, and an even-field field data of the $(J+1)^{th}$ scan line to the even-field memory block, wherein I, J are natural numbers.

The timing controller according to a preferred embodiment of the present invention further comprises a scan control signal generator for receiving a clock signal, a horizontal synchronous signal and a vertical synchronous signal and outputting a start pulse, the first gate output enable signal, the second gate output enable signal and the third gate output enable signal. The first gate output enable signal comprises six periods, and is active in the first, second and fourth periods, but inactive in the other periods. The second gate output enable signal comprises six periods, and is active in the third, the fourth and the sixth period, but inactive in the other periods. The third gate output enable signal comprises six periods, and is active in the second, the fifth and the sixth periods, but inactive in the other periods.

In the timing controller according to a preferred embodiment of the present invention, the memory controller is used to output the data of the $M^{th}$ scan line stored in the even-field memory block and control the memory to write the odd-field field data of the $(M+1)^{th}$ scan line to the odd-field memory block and the even-field field data of the $(M+1)^{th}$ scan line to the even-field memory block when the first gate output enable signal is active and the second and third gate output enable signals are inactive; output the data of the $(M-1)^{th}$ scan line stored in the odd-field memory block when the first and the third gate output enable signals are active and the second gate output enable signal is inactive; output the data of the $(M+1)^{th}$ scan line stored in the even-field memory block and control the memory to write the odd-field field data of the $(M+2)^{th}$ scan line to the odd-field memory block and the even-field field data of the $(M+2)^{th}$ scan line to the even-field memory block when the second gate output enable signal is active and the first and the third gate output enable signals are inactive; output the data of the $M^{th}$ scan line stored in the odd-field memory block when the first and second gate output enable signals are active and the third gate output enable signal is inactive; output the data of the $(M+2)^{th}$ scan line stored in the even-field memory block and control the memory to write the odd-field field data of the $(M+3)^{th}$ scan line to the odd-field memory block and the even-field field data of the $(M+3)^{th}$ scan line to the even-field memory block when the third gate output enable signal is active and the first and second gate output enable signals are inactive; and output the data of the $(M+1)^{th}$ scan line stored in the odd-field memory block when the first and the third gate output enable signal are active and the second gate output enable signal is inactive, wherein M is a natural number, and is larger than 1.

The present invention provides a timing controller applicable for controlling a pixel level multiplexing display panel. The timing controller comprises a scan control signal generator, a memory and a memory controller. The scan control signal generator is used to receive a clock signal, a horizontal synchronous signal and a vertical synchronous signal, and output a start pulse, the first gate output enable signal, the second gate output enable signal and the third gate output enable signal. The first gate output enable signal comprises nine periods, and is active in the first, second, third, sixth and eighth periods, but inactive in the other periods. The second gate output enable signal comprises nine periods, and is active in the second, fourth, fifth, sixth and ninth periods, but inactive in the other periods. The third gate output enable signal comprises nine periods, and is active in the third, fifth, seventh, eighth and ninth periods, but inactive in the other periods. The memory comprises an odd-field memory block and an even-field memory block. The memory controller is coupled to the memory and controls the memory. When two of the first, second and third gate output enable signals are active and the circumstance remains for a preset time interval, the memory controller is used to output the data of the $(I-1)^{th}$ scan line stored in the odd-field memory block. When one of the first, second and third gate output enable signals is active, and the other two are inactive, the memory controller is used to output the data of the $J^{th}$ scan line stored in the even-field memory block and control the memory to write the odd-field field data of the $(J+1)^{th}$ scan line to the odd-field memory block, and the even-field field data of the $(J+1)^{th}$ scan line to the even-field memory block, wherein I, J are natural numbers, I is larger than 1, and J is larger than 0.

In the timing controller according to a preferred embodiment of the present invention, the memory controller is used to output the data of the $M^{th}$ scan line stored in the even-field memory block and control the memory to write the odd-field field data of the $(M+1)^{th}$ scan line to the odd-field memory block and the even-field field data of the $(M+1)^{th}$ scan line to the even-field memory block when the first gate output enable signal is active and the second and third gate output enable signals are inactive; output the data of the $(M-1)^{th}$ scan line stored in the odd-field memory block when the first and the third gate output enable signals are active and such circumstance remains for a preset time interval, and the second gate output enable signal is inactive; output the data of the $(M+1)^{th}$ scan line stored in the even-field memory block and control the memory to write the odd-field field data of the $(M+2)^{th}$ scan line to the odd-field memory block to and the even-field field data of the $(M+2)^{th}$ scan line to the even-field memory block when the second gate output enable signal is active and the first and the third gate output enable signals are inactive; output the data of the $M^{th}$ scan line stored in the odd-field memory block when the first and second gate output enable signals are active and such circumstance remains for a preset time interval and the third gate output enable signal is inactive; output the data of the $(M+2)^{th}$ scan line stored in the even-field memory block and control the memory to write the odd-field field data of the $(M+3)^{th}$ scan line to the odd-field memory block and the even-field field data of the $(M+3)^{th}$ scan line to the even-field memory block when the third gate output enable signal is active and the first and the second gate output enable signals are inactive; and output the data of the $(M+1)^{th}$ scan line stored in the odd-field memory block when the first and the third gate output enable signals are active and such circumstance remains for a preset time interval, and the second gate output enable signal is inactive, wherein M is a natural number, and is larger than 1.

In the present invention, as a new pixel level multiplexing display panel is employed in the present invention, and a timing controller is used to control the pixel level multiplexing display panel, the timing controller drives the pixel level multiplexing display panel without changing architectures of conventional scan and data driving circuits, therefore, the present invention not only can eliminate the restrictions on circuit design, enhance the selectivity on the circuit design, but also save the manufacturing cost.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
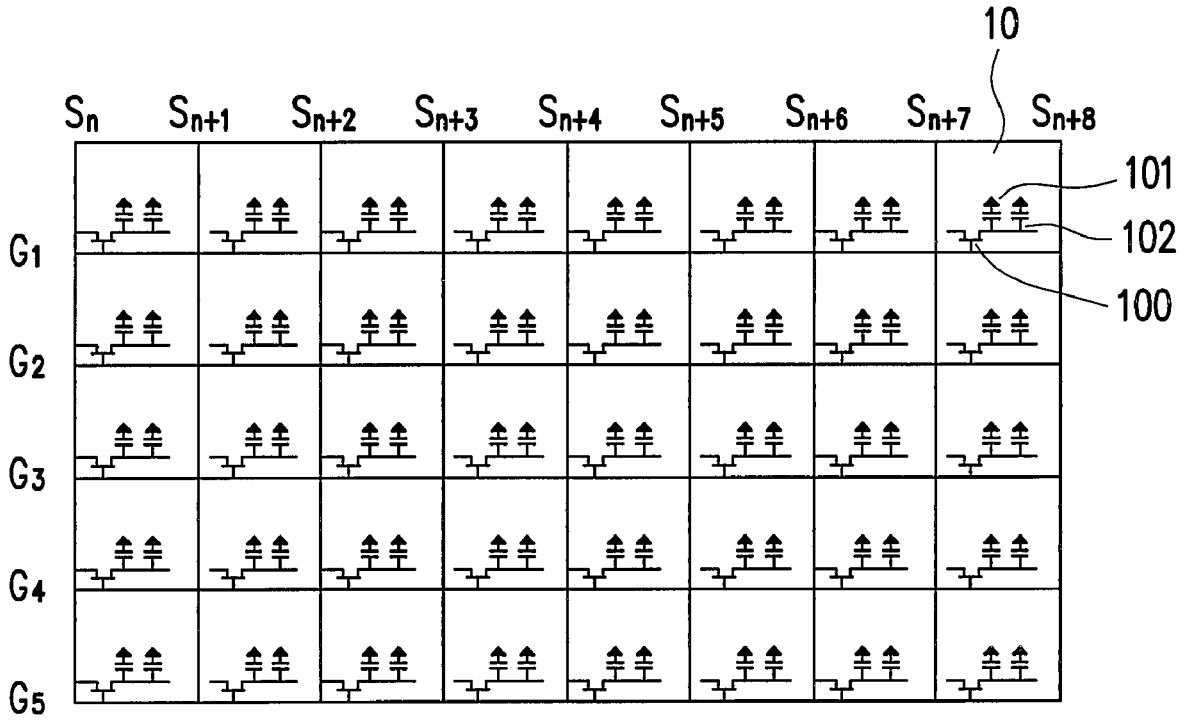
FIG. 1 (PRIOR ART)
FIG. 1 is a part of a circuit diagram of a conventional LCD panel.
Figure 2A:
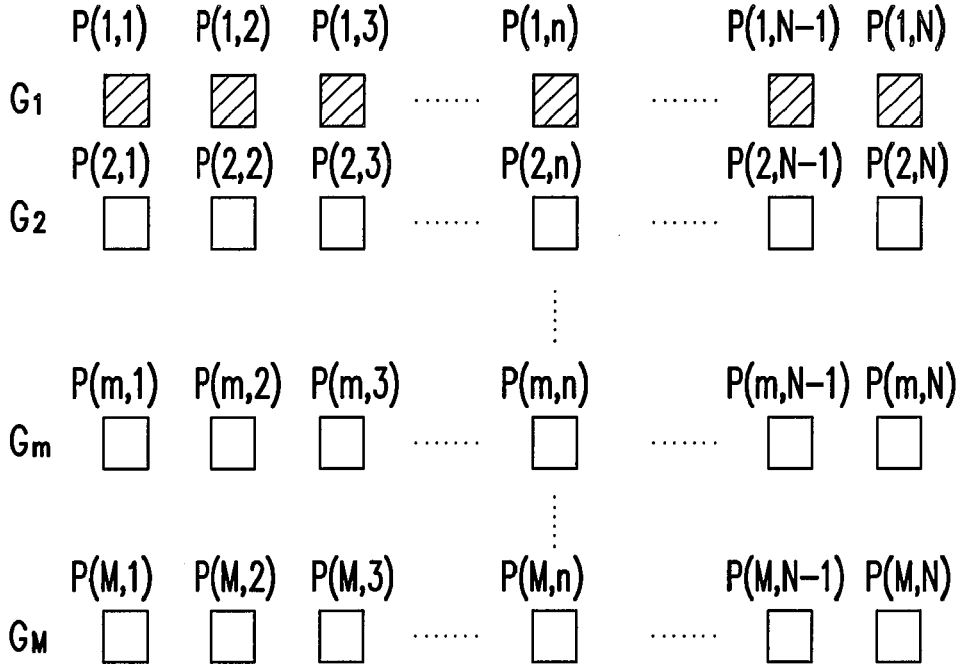
FIG. 2A(PRIOR ART)
FIGS. 2A-2D are driving timings of the conventional LCD panel in the configuration of FIG. 1.
Figure 2B:
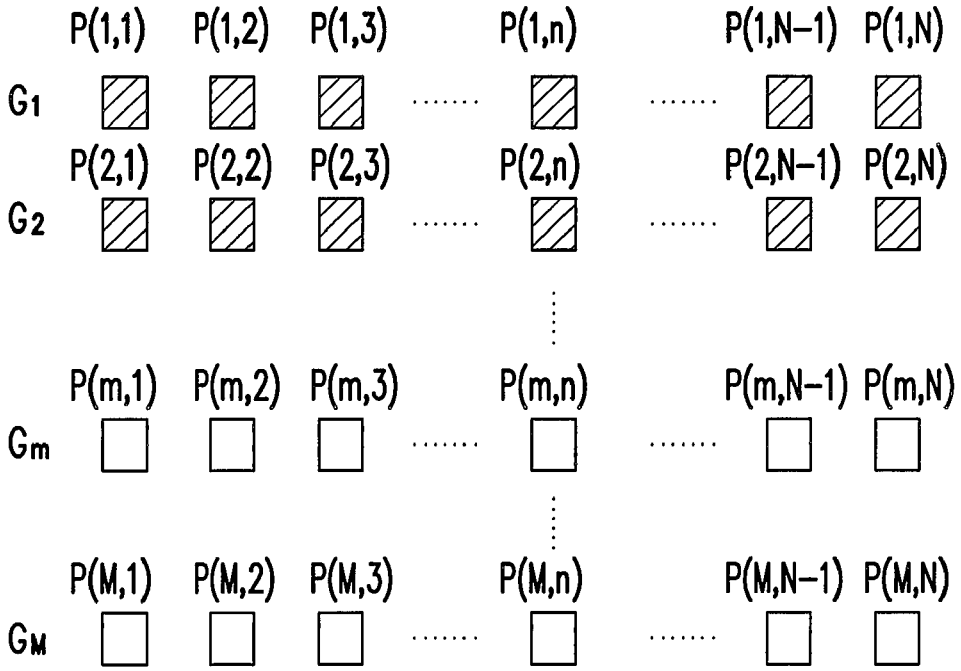
FIG. 2B(PRIOR ART)
Figure 2C:
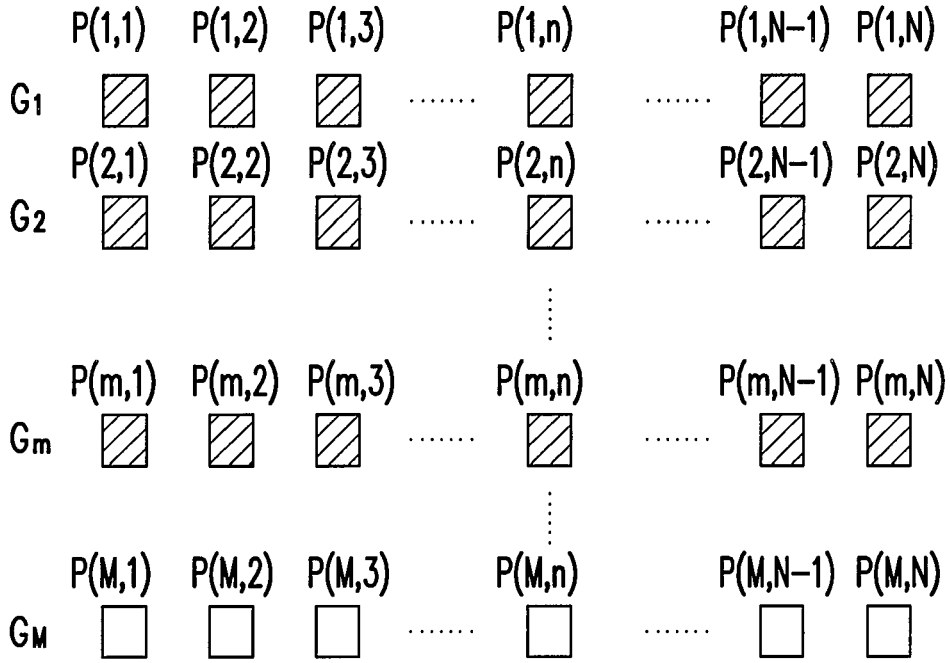
FIG. 2C(PRIOR ART)
Figure 2D:
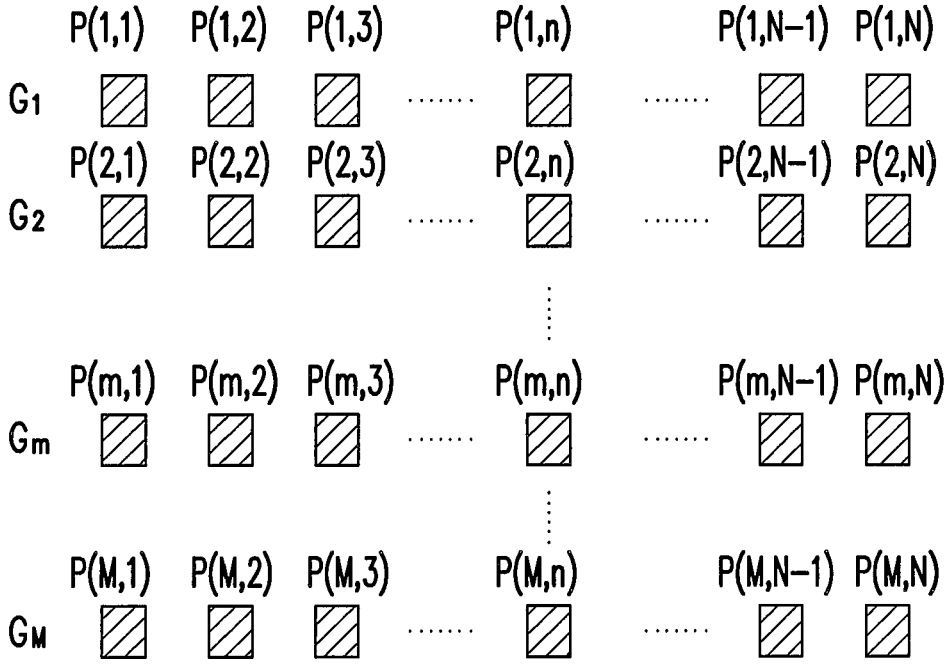
FIG. 2D(PRIOR ART)
Figure 3:
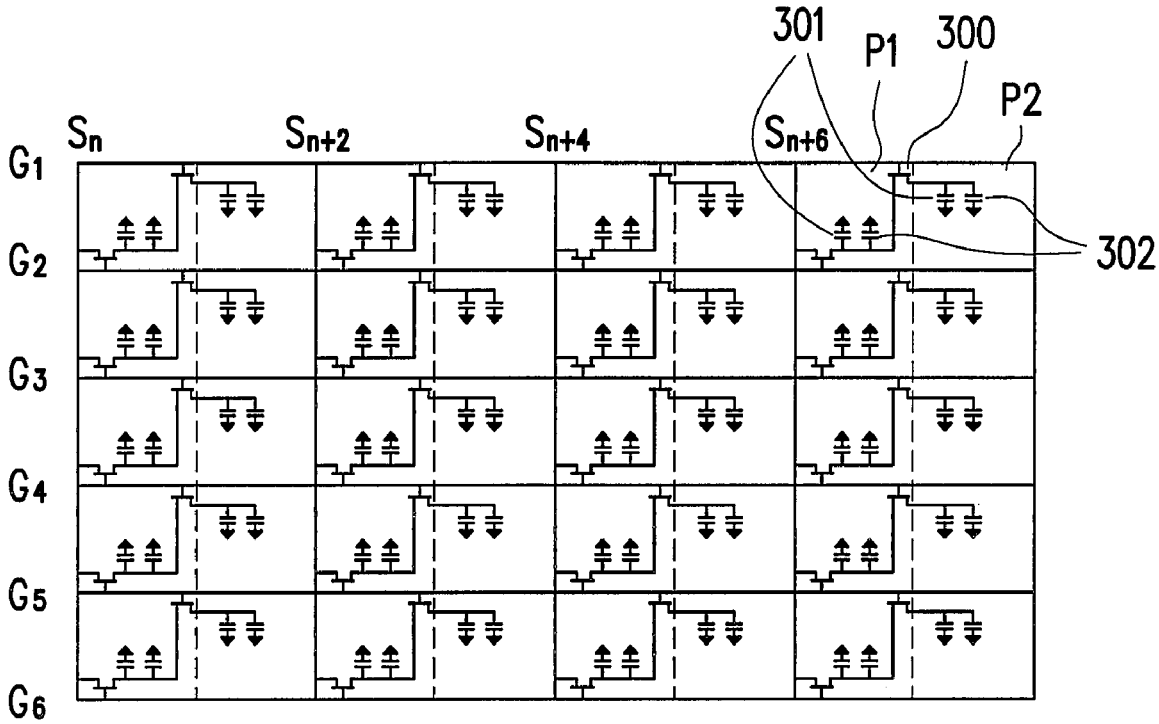
FIG. 3 (PRIOR ART)
FIG. 3 is a conventional pixel level multiplexing display panel.
Figure 4:
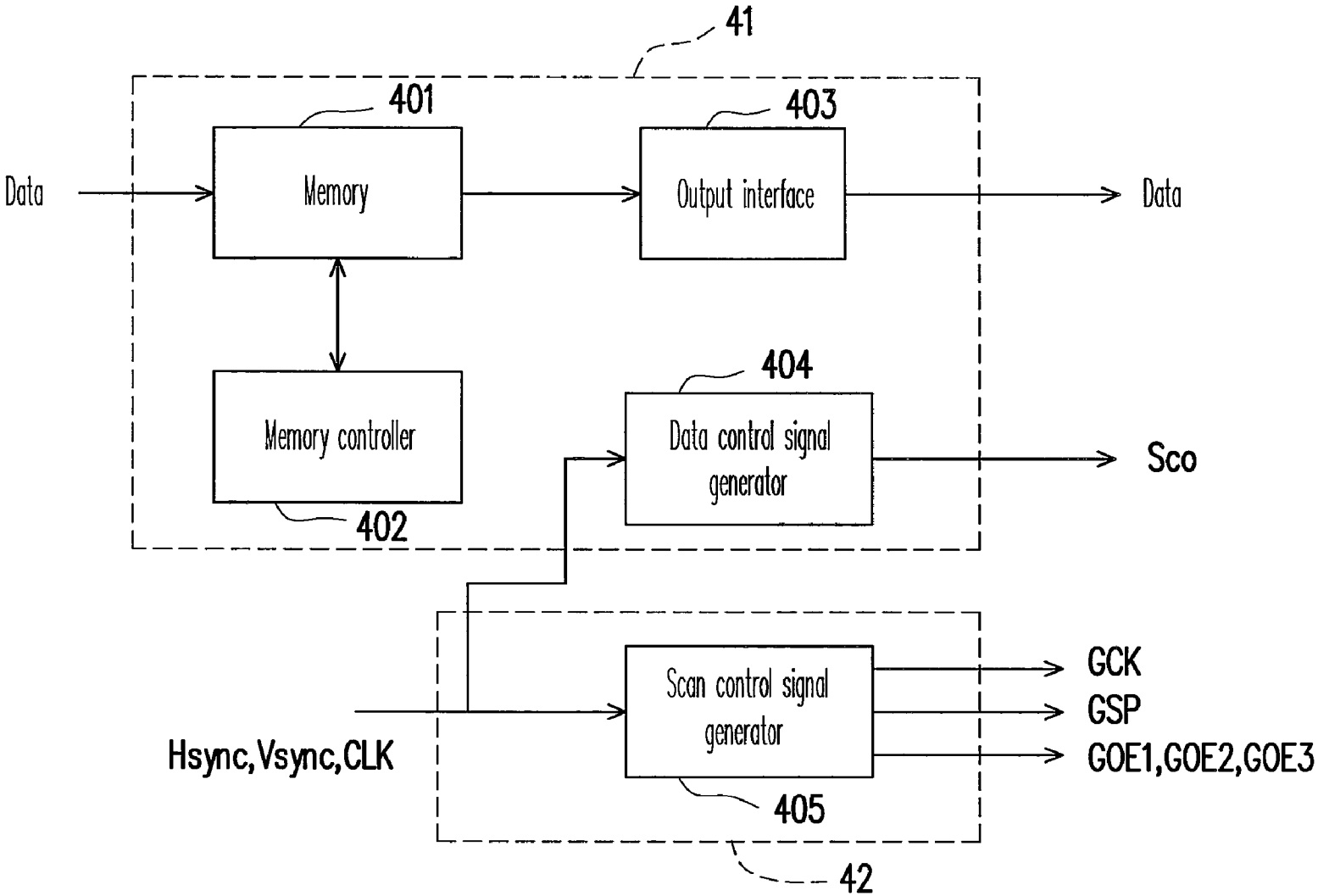
FIG. 4 is a timing controller for controlling a pixel level multiplexing display panel according to an embodiment of the present invention.

FIG. 4 shows a timing controller for controlling a pixel level multiplexing (PLM) display panel according to an embodiment of the present invention. The timing controller comprises a memory 401, a memory controller 402, an output interface 403, a data control signal generator 404 and a scan control signal generator 405. In order to facilitate the illustration, the pixel level multiplexing display panel in FIG. 3 is taken as an example of the panel controlled by the timing controller in this embodiment. However, those skilled in the art should know that the timing controller provided in the present invention may be used to control other similar types of pixel level multiplexing display panels, and thus, the present invention is not limited to this.

The pixel level multiplexing display panel of FIG. 3 mainly comprises 6 scan lines $G_1$-$G_6$ and 4 data lines $S_n$-$S_{n+6}$ disposed to be crossed with each other (in order to facilitate the illustration, a smaller display panel is used as an example herein), wherein each of the data lines is coupled to a plurality of first pixels P1 of $S_n$-$S_{n+6}$. Each of the first pixels P1 is coupled to a second pixel P2. The $i^{th}$ first pixel P1 determines whether to be conducted to receive a data signal on the data lines $S_n$-$S_{n+6}$ according to a scan signal on the $i^{th}$ scan line $G_i$. The $i^{th}$ second pixel P2 determines whether to be conducted to receive a data signal on the data lines $S_n$-$S_{n+6}$ according to scan signals on the $G_i^{th}$ and the $(G_i+1)^{th}$ scan lines. Each first pixel P1 and each second pixel P2 respectively comprises a TFT 300, a storage capacitor 301 and a pixel capacitor 302, and their coupling relationship is as shown in FIG. 3.

Figure 5:
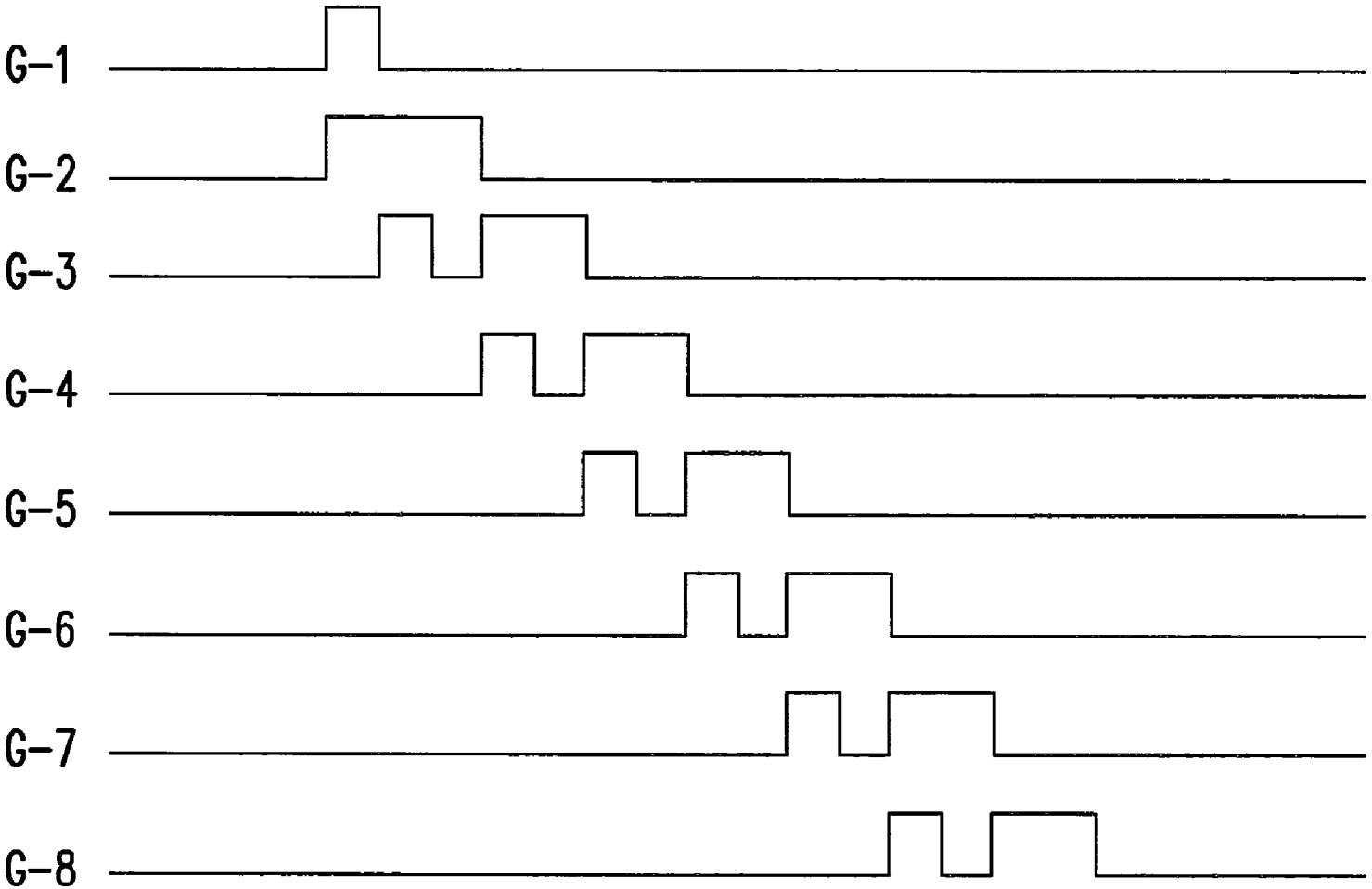
FIG. 5 is a scan driving timing diagram of the conventional pixel level multiplexing display panel of FIG. 3.
Figure 6A:
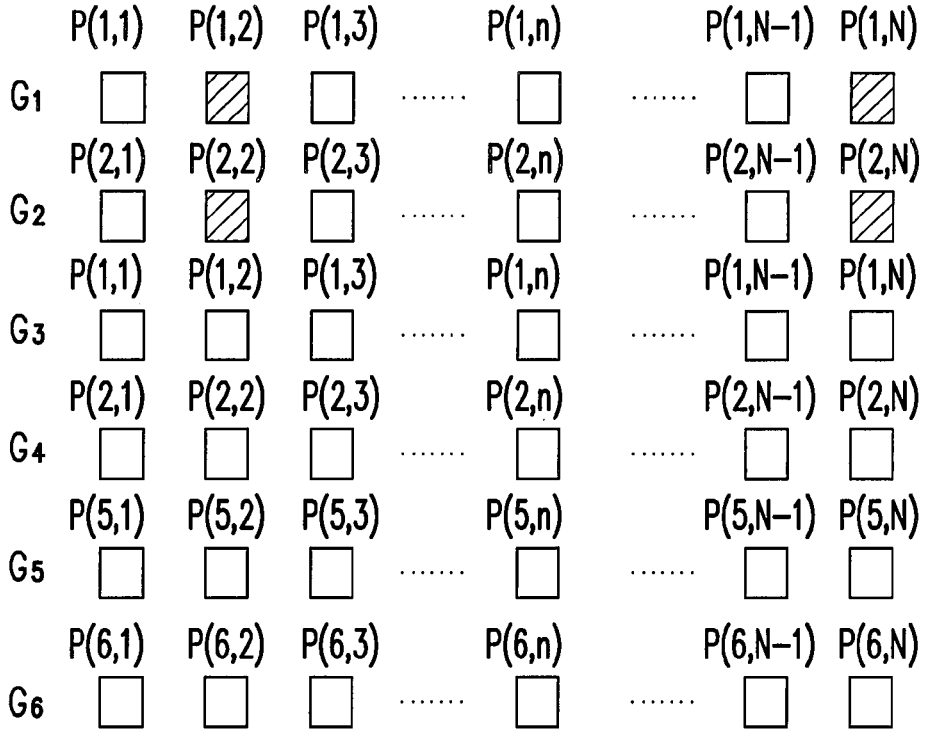
FIGS. 6A-6F show data input order for the conventional pixel level multiplexing display panel of FIG. 3.
Figure 6B:
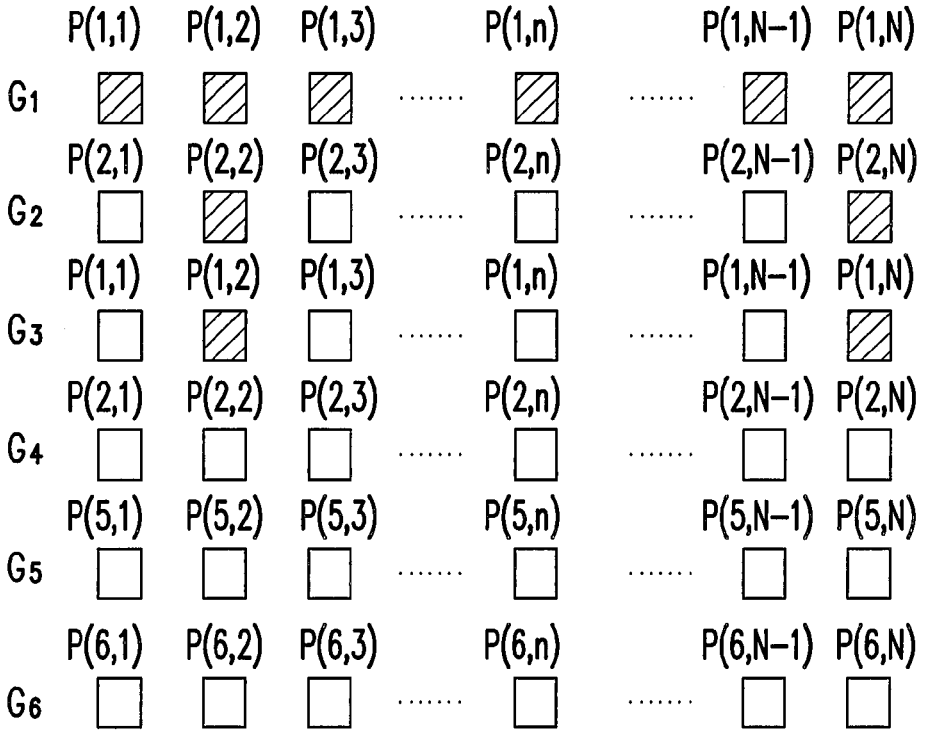
Figure 6C:
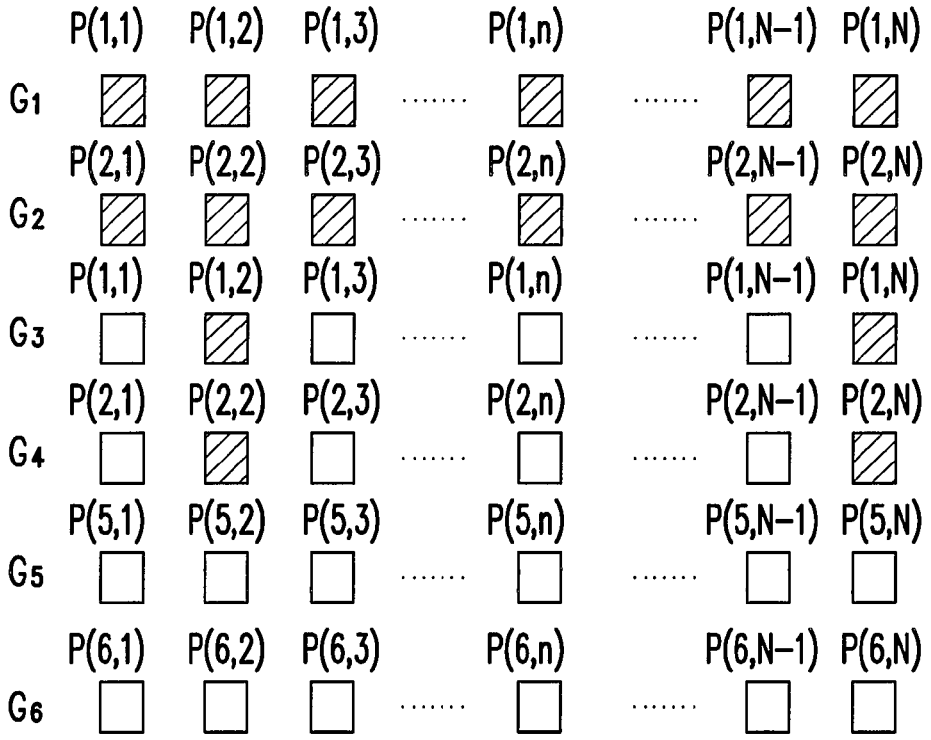
Figure 6D:
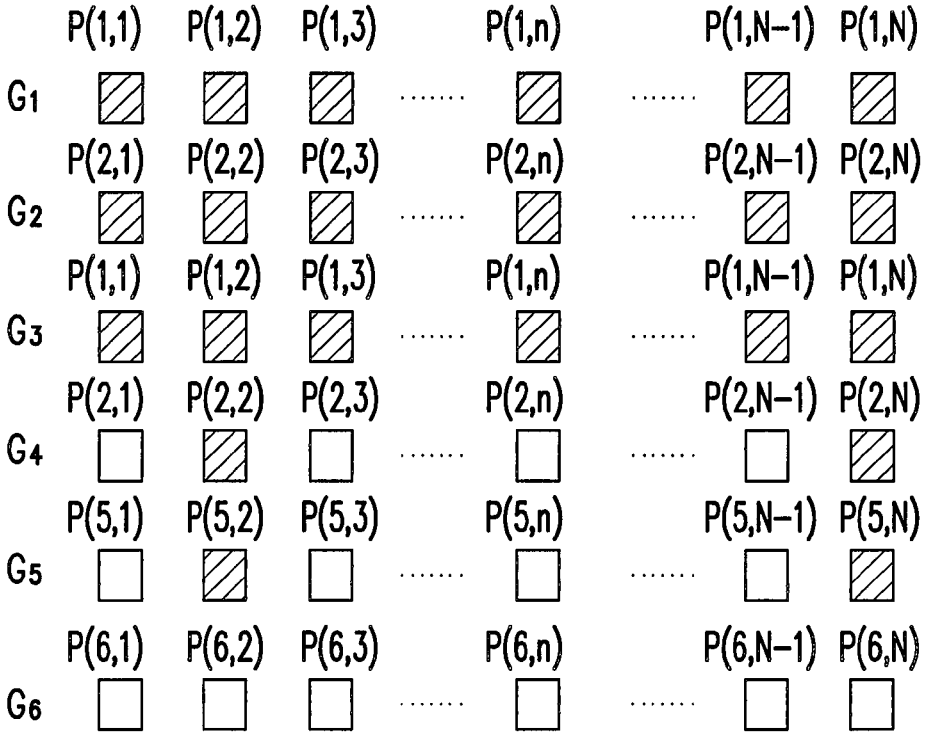
Figure 6E:
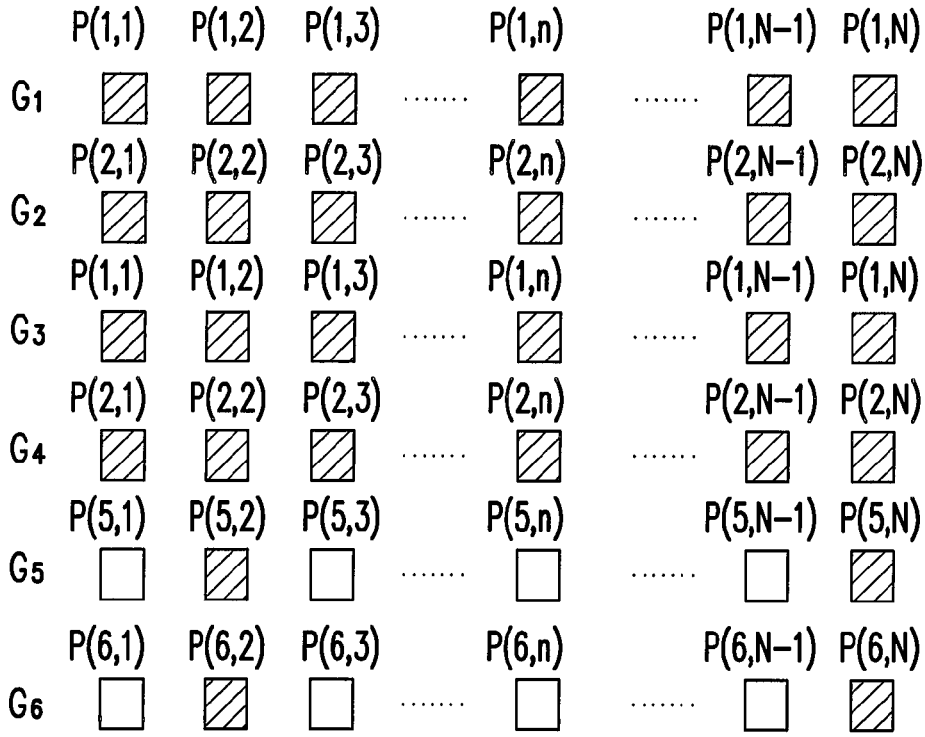
Figure 6F:
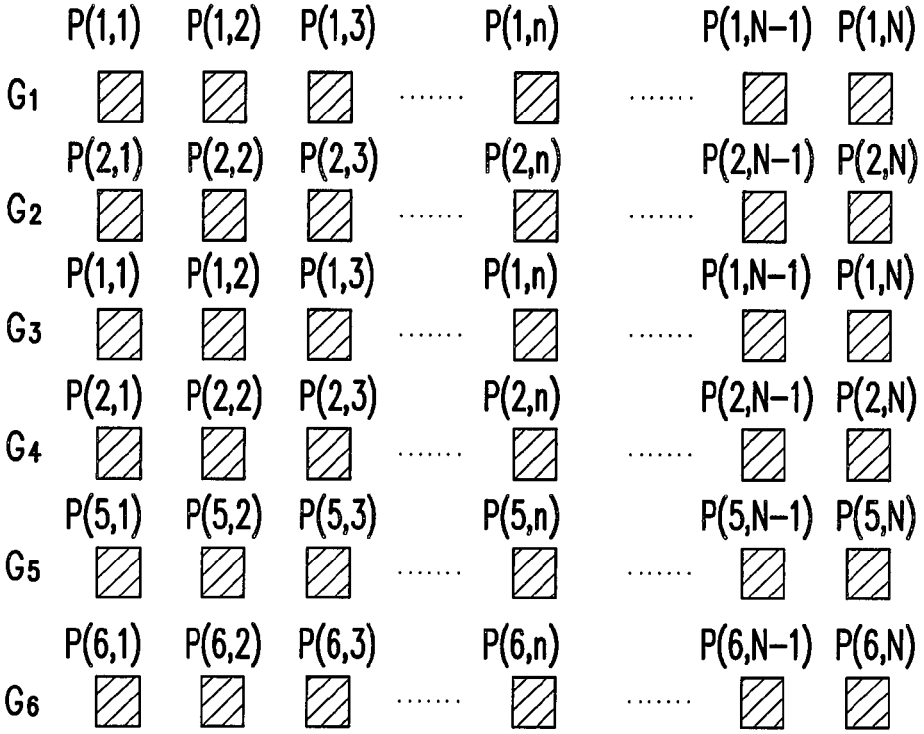

The main scan driving timing of the panel is shown in FIG. 5, and the data input order is shown in FIGS. 6A-6F. As it can be seen from the timing and the data that, in the panel, the data of the first (even-field) pixel P1 and the data of the second (odd-field) pixel P2 are alternatively inputted to the data line, and the scan signals are inputted to the gate lines of the panel in sequence in the manner of FIG. 5, so as to drive the panel of FIG. 3. In the embodiment of the present invention, a timing controller is designed according to the above timing without changing the architectures of the scan and data drivers for the conventional liquid crystal screen. The panel is of an architecture that the first pixel P1 and the second pixel P2 share a source line, therefore, the data input order is as shown in FIG. 6 that: the data 1-E and 2-E of the even-field pixels of the first and second scan lines are input first; next, the data 1-O of the odd-field pixel of the first scan line is input; and the data 3-E of the even-field pixel of the third scan line is input; and then, 2-O→4-E→3-O→5-E . . . , and so forth.

Figure 7:
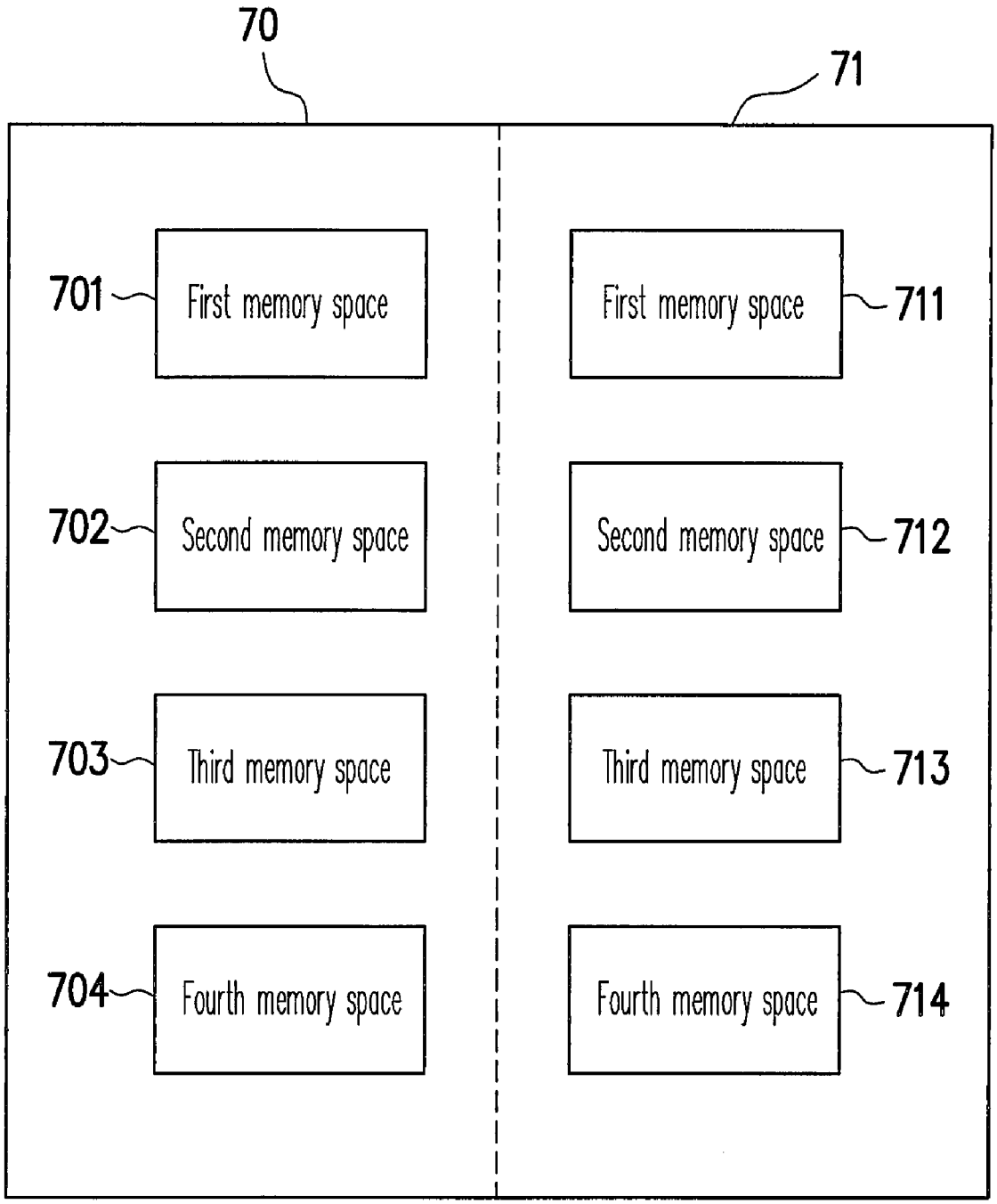
FIG. 7 is a detailed configuration diagram of a memory 401 in the embodiment of the present invention of FIG. 4.

First, referring to FIG. 4, as for the panel data processing part 41 of, a memory 401, a memory controller 402, an output interface 403 and a data control signal generator 404 are included. FIG. 7 is a detailed configuration diagram of the memory 401 in the embodiment of the present invention of FIG. 4. In this embodiment, the output interface 403 is coupled to the memory 401, and the memory 401 outputs data to the data driver via the output interface 403. The data control signal generator 404 is used to receive a horizontal synchronous signal Hsync, a vertical synchronous signal Vsync and a clock signal CLK, and output a source control signal Sco. The memory 401 comprises an odd-field memory block 70 and an even-field memory block 71, wherein the odd-field memory block 70 and the even-field memory block 71 comprise a first memory space (701, 711), a second memory space (702, 712), a third memory space (703, 713) and a fourth memory space (704, 714) respectively.

The first memory space 701, second memory space 702, third memory space 703 and fourth memory space 704 of the odd-field memory block 70 are used to store the odd-field field data (data of the first pixel) of the $(4X+1)^{th}$, $(4X+2)^{th}$, $(4X+3)^{th}$ and $(4X+4)^{th}$ lines respectively. The first memory space 711, second memory space 712, third memory space 713 and fourth memory space 714 of the even-field memory block 71 are used to store the even-field field data (data of the second pixel) of the $(4X+1)^{th}$, $(4X+2)^{th}$, $(4X+3)^{th}$ and $(4X+4)^{th}$ lines respectively, wherein X represents a natural number being larger than 0.

FIGS. 8A-8F are data input/output diagrams of the memory 401 in the timing controller according to an embodiment of the present invention. In the diagrams, the blocks with oblique lines represent idle memory spaces. Referring to FIGS. 8A-8F, when initiating, the memory controller 402 controls the memory to store the data of the first and second scan lines to the memory, wherein the memory controller 402 controls the odd-field field data 1-O of the first scan line to be written to the first memory space 701 of the odd-field memory block 70, the even-field field data 1-E of the first scan line to be written to the first memory space 711 of the even-field memory block 71, the odd-field field data 2-O of the second scan line to be written to the second memory space 702 of the odd-field memory block 70, the even-field field data 2-E of the second scan line to be written to the second memory space 712 of the even-field memory block 71.

Figure 8A:
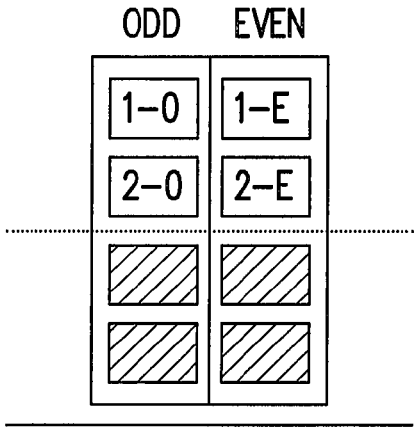
FIGS. 8A-8F are data input/output diagrams of the memory 401 in the timing controller according to the embodiment of the present invention.
Figure 8B:
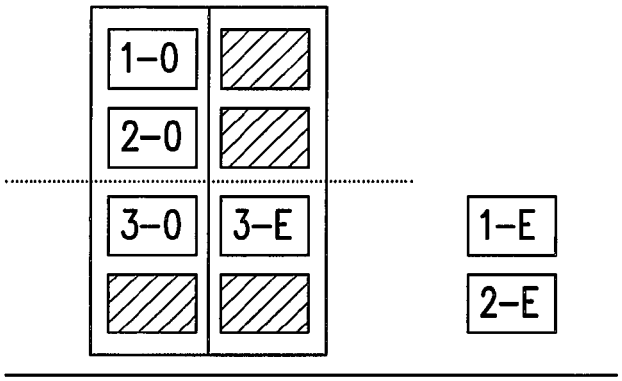
Figure 8C:
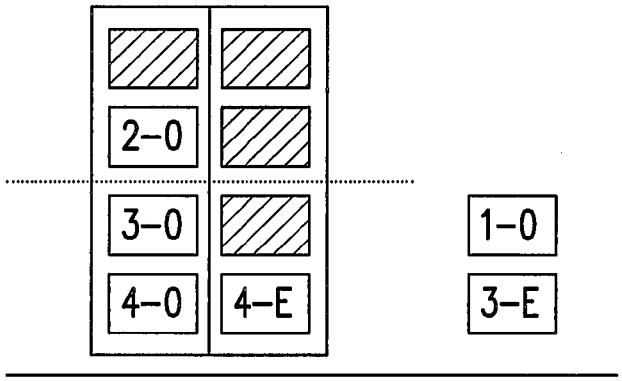

Next, in the next time period, the memory controller 402 controls the memory 401 to output the even-field field data 1-E of the first scan line; next, the memory controller 402 controls the memory 401 to output the even-field field data 2-E of the second scan line, and controls the memory to receive the data 3-O and 3-E of the third scan line and then store the data 3-O and 3-E of the scan line to the third memory space 703 of the odd-field memory block 70 and the third memory space 713 of the even-field memory block 71 respectively(as shown in FIG. 8B). In the next time period, the memory controller 402 controls the memory 401 to output the odd-field field data 1-O of the first scan line; next, the memory controller 402 controls the memory 401 to output the even-field field data 3-E of the third scan line, and controls the memory to receive the data 4-O and 4-E of the fourth scan line and then store the data 4-O and 4-E of the scan line to the fourth memory space 704 of the odd-field memory block 70 and the fourth memory space 714 of the even-field memory block 71 respectively(as shown in FIG. 8C).

Figure 8D:
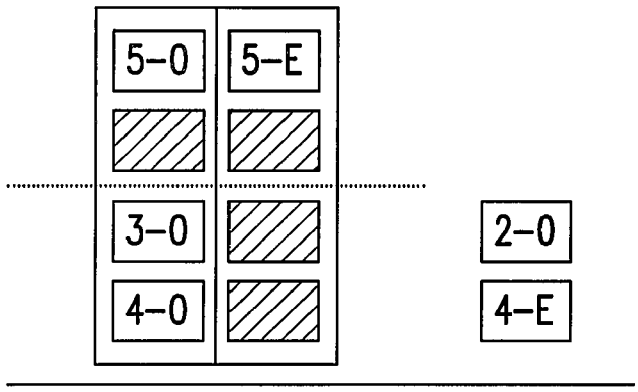
Figure 8E:
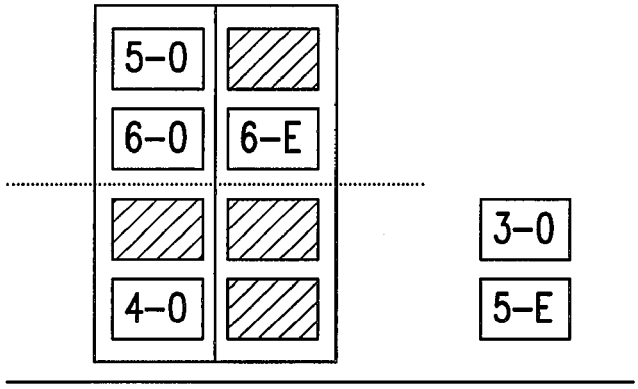
Figure 8F:
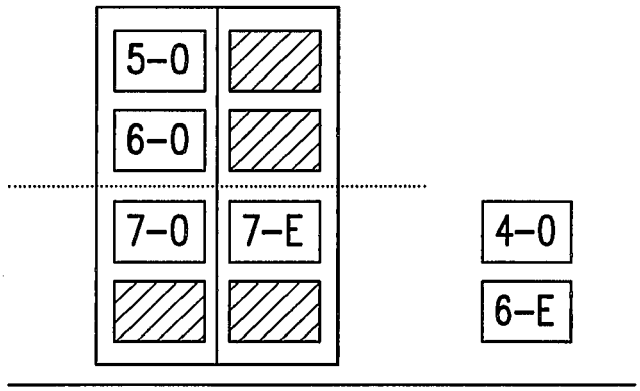

The following steps may be derived from the above by analogy. The memory 402 outputs 2-O and 4-E, inputs 5-O and 5-E (as shown in FIG. 8D)→the memory 402 outputs 3-O and 5-E, inputs 6-O and 6-E (as shown in FIG. 8E)→the memory 402 outputs 4-O and 6-E, inputs 7-O and 7-E (as shown in FIG. 8F)→the memory 402 outputs 5-O and 7-E, inputs 8-O and 8-E, and so forth.

The operation of the panel data processing part 41 has been illustrated above, and then, referring to FIG. 4, as for the panel scan processing part 42, a scan control signal generator 405 is included, which receives the clock signal CLK, the horizontal synchronous signal Hsync and the vertical synchronous signal Vsync, and thereby outputs a start pulse GSP, a gate clock signal GCK, a first gate output enable signal GOE1, a second gate output enable signal GOE2 and a third gate output enable signal GOE3.

A common scan driving circuit is used not only to receive the start pulses GSP and then output and enable them one by one, but also to receive a gate output enable signal (Gate Output Enable, GOE), so as to control its output state. The first gate output enable signal GOE1 is used to control the $1^{st}$, $4^{th}$, $7^{th}$, . . . $(3K+1)^{th}$ output signals of the scan driving circuit, the second gate output enable signal GOE2 is used to control the $2^{nd}$, $5^{th}$, $8^{th}$ . . . $(3K+2)^{th}$ output signals of the scan driving circuit, and the third gate output enable signal GOE3 is used to control the $3^{rd}$, $6^{th}$, $9^{th}$ . . . $(3K+3)^{th}$ output signals of the scan driving circuit, wherein K represents a natural number being larger than 0. In this embodiment, when the scan control signal is active (e.g., in a logic high level in this embodiment), the output of the corresponding scan driving circuit is in a disable state, and when the scan control signal is inactive (e.g., in a logic low level in this embodiment), the corresponding scan driving circuit outputs the corresponding scan signal according to the start pulse GSP and the clock signal CLK, so as to control the panel.

Figure 9:
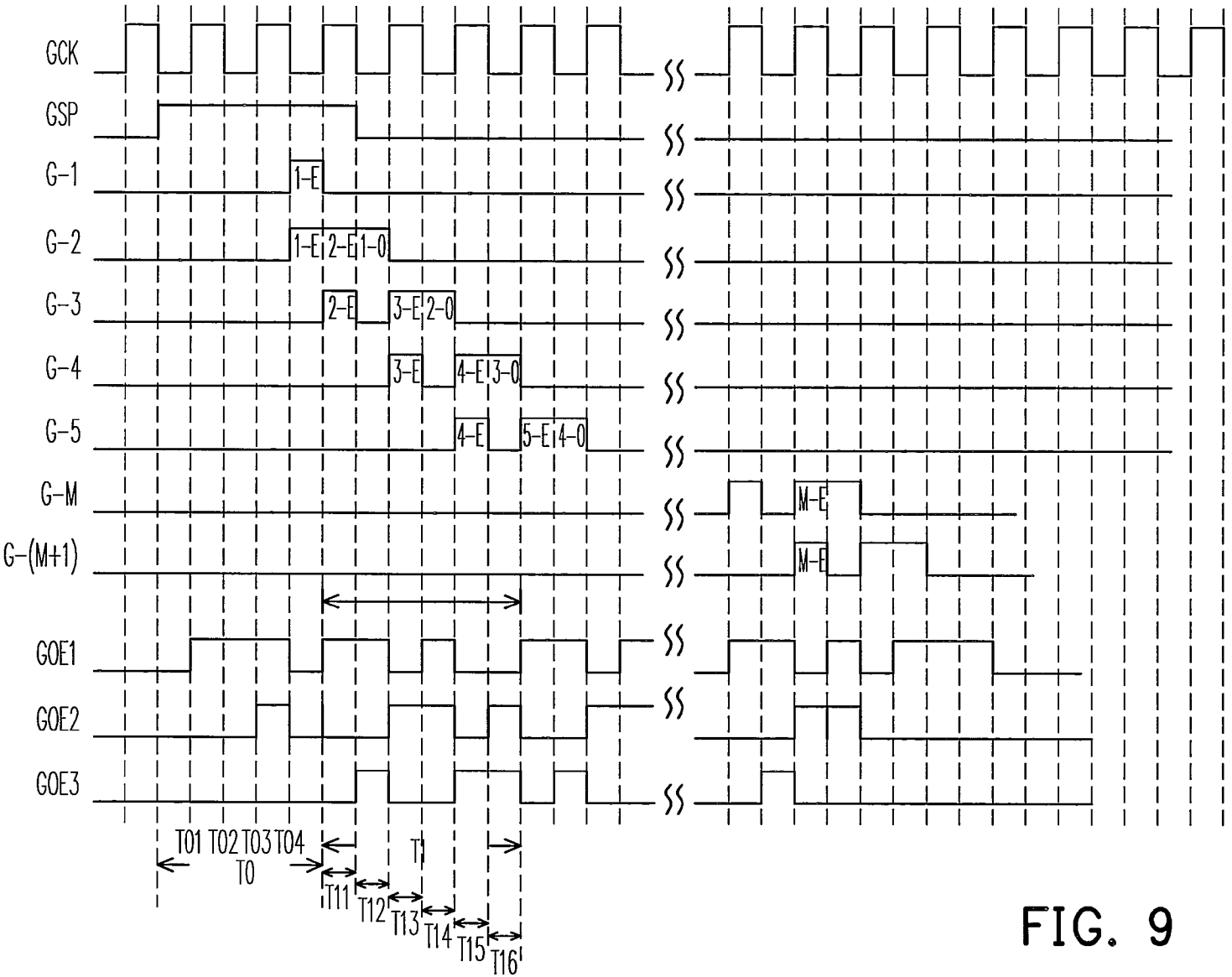
FIG. 9 is a clock relationship diagram of a start pulse GSP, a gate clock signal GCK, a first gate output enable signal GOE1, a second gate output enable signal GOE2 and a third gate output enable signal GOE3 output by the scan control signal generator 405 and the scan signals output by the scan driving circuit in the embodiment of the present invention of FIG. 4.

FIG. 9 is a clock relationship diagram of a start pulse GSP, a gate clock signal GLCK, a first gate output enable signal GOE1, a second gate output enable signal GOE2 and a third gate output enable signal GOE3 output by the scan control signal generator 405 and the scan signals output by the scan driving circuit in the embodiment of the present invention of FIG. 4. Referring to FIG. 9, first, during the initial scan period T0, the scan control signal generator 405 outputs a start pulse GSP according to the horizontal synchronous signal Hsync and the vertical synchronous signal Vsync, wherein the time length of the start pulse GSP is 3 times of a period of the gate clock GCK. In the next time period T01, the first gate output enable signal GOE1 is active (in this embodiment, it is designed that the logic high level is active, and the logic low level is inactive; those skilled in the art should know the logic high/low levels are selective when designing, thus the present invention is not limited to this).

It can be seen that since the time length of the start pulse GSP is 3 times of a period of the gate clock GCK, originally the scan signal G-1 on the first gate line should output a logic high level with a length of 3 times of a period of the gate clock GCK at the time period T01. As the first gate output enable signal GOE1 is in an active state, the scan signal G-1 on the first gate line remains in a logic low level. Next, at the time period T03, the second gate output enable signal GOE2 is in an active state, such that the scan signal G-2 on the second gate line remains in a logic low level. At the time period T04, the first gate output enable signal GOE1 and the second gate output enable signal GOE2 both turn to be in an inactive state from the active state simultaneously, such that the scan signal G-1 on the first gate line and the scan signal G-2 on the second gate line are both in the logic high level. At this point, the timing controller outputs the even-field field data 1-E of the first scan line.

Then, all of the gate output enable signals GOE1-GOE3 are divided into six periods T11-T16, and the six periods T11-T16 are used to perform cycling operation until completing the scanning process. During the first period T11, the gate output enable signal GOE1 is active, and the other two GOE2, GOE3 are inactive, and at this point, the scan signals G-2 and G-3 on the second and third scan lines are both in a logic high level, thus, the timing controller outputs the even-field field data 2-E of the second scan line. During the second period T12, the gate output enable signals GOE1 and GOE3 are active, and GOE2 is inactive, and at this point, only the scan signal G-2 on the second scan line is in a logic high level, thus, the timing controller outputs the odd-field field data 1-O of the first scan line.

During the third period T13, the gate output enable signal GOE2 is active, the other two GOE1, GOE3 are inactive, and at this point, the scan signals G-3 and G-4 on the third and fourth scan lines are both in a logic high level, thus, the timing controller outputs the even-field field data 3-E of the third scan line. During the fourth period T14, the gate output enable signals GOE1 and GOE2 are active, and GOE3 is inactive, and at this point, only the scan signal G-3 on the third scan line is in a logic high level, thus, the timing controller outputs the odd-field field data 2-O of the second scan line.

During the fifth period T15, the gate output enable signal GOE3 is active, and the other two GOE1, GOE2 are inactive, and at this point, the scan signals G-4 and G-5 on the fourth and fifth scan lines are both in a logic high level, thus the timing controller outputs the even-field field data 4-E of the fourth scan line. During the sixth period T16, the gate output enable signals GOE2 and GOE3 are active, and GOE1 is inactive, and at this point, only the scan signal G-4 on the fourth scan line is in a logic high level, thus, the timing controller outputs the odd-field field data 3-O of the third scan line. Next, cyclic operations are conducted as shown in FIGS. 6A-6F, which thus will not be described herein any more.

Figure 10:
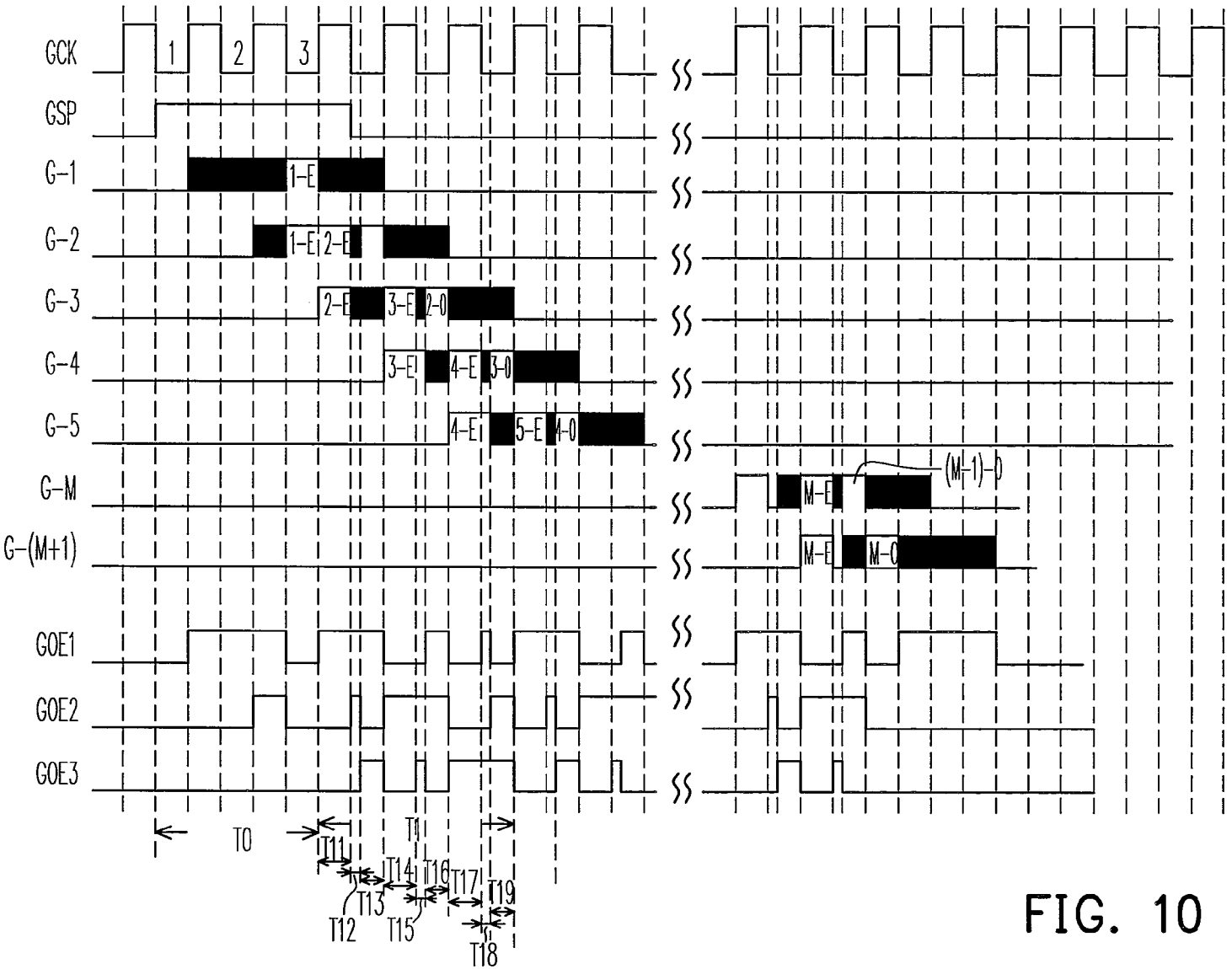
FIG. 10 is a clock relationship diagram of a start pulse GSP, a gate clock signal GCK, a first gate output enable signal GOE1, a second gate output enable signal GOE2 and a third gate output enable signal GOE3 output by the scan control signal generator 405 and the scan signals output by the scan driving circuit in the embodiment of the present invention of FIG. 4.

The above embodiment of the scan control signal generator 405 is one of the implementation methods of the present invention, and the present invention may still be implemented through the method shown in FIG. 10. FIG. 10 is a clock relationship diagram of a start pulse GSP, a gate clock signal GCK, a first gate output enable signal GOE1, a second gate output enable signal GOE2 and a third gate output enable signal GOE3 output by the scan control signal generator 405 and the scan signals output by the scan driving circuit in the embodiment of the present invention of FIG. 4. Referring to FIG. 10, the clock during the initial scan period TO is the same as that of the embodiment of FIG. 9, thus it will not be described herein. However, their difference lies in that the gate output enable signals GOE1-GOE3 are divided into nine periods T11-T19, and then, the nine periods T11-T19 are used as a cycle for conducting cycling operation until the scanning process is completed.

During the first period T11, the gate output enable signal GOE1 is active, and the other two gate output enable signals GOE2, GOE3 are inactive, and at this point, both the scan signals G-2 and G-3 on the second and third scan lines are in a logic high level, thus, the timing controller outputs the even-field field data 2-E of the second scan line. During the third period T13, the gate output enable signals GOE1 and GOE3 are active, and GOE2 is inactive, and at this point, only the scan signal G-2 on the second scan line is in a logic high level, thus, the timing controller outputs the odd-field field data 1-O of the first scan line. A second period T12 of a preset time interval is added between the first period T11 and the third period T13, and during the second period T12, the gate output enable signals GOE1 and GOE2 are active, and GOE3 is inactive, thus, the timing controller does not output any data. The second period T12 is used to avoid the overlapping of data, so as to perfect the displaying effect.

Then, during the fourth period T14, the gate output enable signal GOE2 is active, and the other two gate output enable signals GOE1, GOE3 are inactive, and at this point, both the scan signals G-3 and G-4 on the third and fourth scan lines are in a logic high level, thus, the timing controller outputs the even-field field data 3-E of the third scan line. During the sixth period T16, the gate output enable signals GOE1 and GOE2 are active, GOE3 is inactive, and at this point, only the scan signal G-3 on the third scan line is in a logic high level, thus, the timing controller outputs the odd-field field data 2-O of the second scan line. Similarly, a fifth period T15 of a preset time interval is added between the fourth period T14 and the sixth period T16, and during the fifth period T15, the gate output enable signals GOE2 and GOE3 are active, GOE1 is inactive, thus, the timing controller does not output any data.

During the seventh period T17, the gate output enable signal GOE3 is active, and the other two gate output enable signals GOE1, GOE2 are inactive, and at this point, both the scan signals G-4 and G-5 on the fourth and fifth scan lines are in a logic high level, thus, the timing controller outputs the even-field field data 4-E of the fourth scan line. During the ninth period T19, the gate output enable signals GOE2 and GOE3 are active, GOE1 is inactive, and at this point, only the scan signal G-4 on the fourth scan line is in a logic high level, thus, the timing controller outputs the odd-field field data 3-O of the third scan line. Similarly, an eighth period T18 of a preset time interval is added between the seventh period T17 and the ninth period T19, and during the eighth period T18, the gate output enable signals GOE2 and GOE3 are active, GOE1 is inactive, thus, the timing controller does not output any data.

To sum up, as a new pixel level multiplexing display panel is employed in the present invention, and a timing controller is used to control the pixel level multiplexing display panel, the timing controller drives the pixel level multiplexing display panel without changing the architectures of conventional gate and source driving circuits. Therefore, the present invention can eliminate the restrictions on circuit design and enhance the selectivity on the circuit design. Moreover, since the timing controller provided by the present invention can be implemented without changing the architectures of the conventional scan driver and data driver, the effect of saving the cost can be further achieved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A timing controller for outputting a scan line data according to outputted a first, a second and a third gate output enable signals to drive a pixel level multiplexing display panel, comprising:

a memory comprising an odd-field memory block and an even-field memory block; and a memory controller coupled to the memory and controlling the memory, for controlling the data output of a $(I-1)^{th}$ scan line stored in the odd-field memory block when two of a first, a second and a third gate output enable signals are active, and for controlling the data output of a $J^{th}$ scan line stored in the even-field memory block when one of the first, the second and the third gate output enable signals is active but the other two are inactive, wherein I and J are natural numbers, and I is larger than 1 and J is larger than 0, wherein the memory controller is used to output a data of the $M^{th}$ scan line stored in the even-field memory block and control the memory to write the odd-field field data of the $(M+1)^{th}$ scan line to the odd-field memory block and write the even-field field data of the $(M+1)^{th}$ scan line to the even-field memory block when the first gate output enable signal is active and the second and the third gate output enable signals are inactive; output the data of the $(M-1)^{th}$ scan line stored in the odd-field memory block when the first and the third gate output enable signals are active and the second gate output enable signal is inactive; output the data of the $(M+1)^{th}$ scan line stored in the even-field memory block and control the memory to write the odd-field field data of the $(M+2)^{th}$ scan line to the odd-field memory block and write the even-field field data of the $(M+2)^{th}$ scan line to the even-field memory block when the second gate output enable signal is active and the first and the third gate output enable signals are inactive; output the data of the $M^{th}$ scan line stored in the odd-field memory block when the first and the second gate output enable signals are active and the third gate output enable signal is inactive; output the data of the $(M+2)^{th}$ scan line stored in the even-field memory block and control the memory to write the odd-field field data of the $(M+3)^{th}$ scan line to the odd-field memory block and write the even-field field data of the $(M+3)^{th}$ scan line to the even-field memory block when the third gate output enable signal is active and the first and the second gate output enable signals are inactive; and output the data of the $(M+1)^{th}$ scan line stored in the odd-field memory block when the first and the third gate output enable signals are active and the second gate output enable signal is inactive; wherein M is a natural number, and is larger than 1.

2. The timing controller as claimed in claim 1 further comprising a scan control signal generator for receiving a clock signal, a horizontal synchronous signal and a vertical synchronous signal, and for outputting a start pulse, the first gate output enable signal, the second gate output enable signal and the third gate output enable signal.

3. The timing controller as claimed in claim 1, wherein the first gate output enable signal comprises six periods, and it is active in the first, second and fourth periods, but inactive in the other periods; the second gate output enable signal comprises six periods, and it is active in the third, fourth and sixth periods, but inactive in the other periods; and the third gate output enable signal comprises six periods, and it is active in the second, fifth and sixth periods, but inactive in the other periods.

4. The timing controller as claimed in claim 1, wherein each of the odd-field memory block and the even-field memory block comprises a first memory space, a second memory space, a third memory space and a fourth memory space respectively.

5. The timing controller as claimed in claim 4, wherein the first memory space of the odd-field memory block is used to store a $(4X+1)^{th}$ odd-field field scan line, the second memory space of the odd-field memory block is used to store a $(4X+2)^{th}$ odd-field field scan line, the third memory space of the odd-field memory block is used to store a $(4X+3)^{th}$ odd-field field scan line, and the fourth memory space of the odd-field memory block is used to store a $(4X+4)^{th}$ odd-field field scan line; the first memory space of the even-field memory block is used to store a $(4X+1)^{th}$ even-field field scan line, the second memory space of the even-field memory block is used to store a $(4X+2)^{th}$ even-field field scan line, the third memory space of the even-field memory block is used to store a $(4X+3)^{th}$ even-field field scan line, and the fourth memory space of the even-field memory block is used to store a $(4X+4)^{th}$ even-field field scan line; wherein X is a natural number being larger than or equal to 0.

6. The timing controller as claimed in claim 1, further comprising:

an output interface coupled to the memory, wherein the memory outputs the scan line data via the output interface.

7. The timing controller as claimed in claim 1, further comprising:

a data control signal generator for receiving a horizontal synchronous signal, a vertical synchronous signal and a clock signal, and outputting a source control signal.

8. The timing controller as claimed in claim 1, wherein the pixel level multiplexing display panel comprises a plurality of scan lines and a plurality of data lines disposed to be crossed with each other, wherein each of the data lines is coupled to a plurality of first pixels, each of the first pixels is coupled to a second pixel, a $k^{th}$ first pixel determines whether to be conducted to receive a data signal on the data line according to a scan signal on a $k^{th}$ scan line, and a $k^{th}$ second pixel determines whether to be conducted to receive the data signal on the data line according to scan signals on the $k^{th}$ and a $(k+1)^{th}$ scan lines, and k is a natural number.

9. The timing controller as claimed in claim 8, wherein each of the first pixels and each of the second pixels comprises a thin film transistor (TFT), a pixel capacitor and a storage capacitor respectively, wherein a gate of the TFT of the $k^{th}$ first pixel is coupled to the $k^{th}$ scan line, a gate of a TFT of the $k^{th}$ second pixel is coupled to the $(k+1)^{th}$ scan line, a first source/drain of the TFT of the $k^{th}$ first pixel is coupled to the corresponding data line, a second source/drain of the TFT of the $k^{th}$ first pixel is coupled to the pixel capacitor and the storage capacitor of the $k^{th}$ first pixel, a first source/drain of the TFT of the $k^{th}$ second pixel is coupled to the second source/drain of the TFT of the $k^{th}$ first pixel, and a second source/drain of the TFT of the $k^{th}$ second pixel is coupled to the pixel capacitor and storage capacitor of the $k^{th}$ second pixel.

10. The timing controller as claimed in claim 1, wherein the data of the $(M-1)^{th}$ scan line stored in the odd-field memory block is further outputted by the memory controller when the first and the third gate output enable signals are active and such circumstance remains for a preset time interval, and the second gate output enable signal is inactive; the data of the $M^{th}$ scan line stored in the odd-field memory block is further outputted by the memory controller when the first and the second gate output enable signals are active and such circumstance remains for a preset time interval, and the third gate output enable signal is inactive; and the data of the $(M+1)^{th}$ scan line stored in the odd-field memory block is further outputted by the memory controller when the first and the third gate output enable signals are active and such circumstance remains for a preset time interval, and the second gate output enable signal is inactive.

11. The timing controller as claimed in claim 10, wherein the first gate output enable signal comprises nine periods, and it is active in the first, second, third, sixth and eighth periods, but inactive in the other periods; the second gate output enable signal comprises nine periods, and it is active in the second, fourth, fifth, sixth and ninth periods, but inactive in the other periods; the third gate output enable signal comprises nine periods, and it is active in the third, fifth, seventh, eighth and ninth periods, but inactive in the other periods.

* * * * *